US008057636B2

(12) United States Patent
Vinson et al.

(10) Patent No.: US 8,057,636 B2
(45) Date of Patent: Nov. 15, 2011

(54) SOFT AND STRONG FIBROUS STRUCTURES

(75) Inventors: Kenneth Douglas Vinson, Toone, TN (US); Eric James Watkins, Lawrenceburg, IN (US); Dale Gary Kavalew, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 348 days.

(21) Appl. No.: 11/820,614

(22) Filed: Jun. 20, 2007

(65) Prior Publication Data

US 2008/0014428 A1 Jan. 17, 2008

Related U.S. Application Data

(60) Provisional application No. 60/860,179, filed on Nov. 20, 2006, provisional application No. 60/831,358, filed on Jul. 17, 2006.

(51) Int. Cl.
*B32B 21/02* (2006.01)
*D21H 11/00* (2006.01)
*D21H 15/00* (2006.01)

(52) U.S. Cl. ..... 162/111; 162/109; 162/123; 162/141; 162/158

(58) Field of Classification Search ..... 162/109, 162/111, 123, 158, 141; 428/357
See application file for complete search history.

(56) References Cited

U.S. PATENT DOCUMENTS

| | | | | |
|---|---|---|---|---|
| 4,300,981 | A * | 11/1981 | Carstens | 162/109 |
| 4,883,564 | A * | 11/1989 | Chen et al. | 162/112 |
| 6,146,494 | A * | 11/2000 | Seger et al. | 162/9 |
| 6,187,137 | B1 * | 2/2001 | Druecke et al. | 162/109 |
| 6,365,000 | B1 * | 4/2002 | Dwiggins et al. | 162/111 |
| 6,419,790 | B1 * | 7/2002 | Leege et al. | 162/112 |
| 6,464,830 | B1 * | 10/2002 | Holz et al. | 162/130 |
| 2002/0061386 | A1 * | 5/2002 | Carson et al. | 428/131 |
| 2004/0163781 | A1 * | 8/2004 | Hernandez-Munoa et al. | 162/91 |
| 2006/0121207 | A1 * | 6/2006 | Prodoehl et al. | 427/458 |

FOREIGN PATENT DOCUMENTS

| | | | |
|---|---|---|---|
| EP | 0 806 521 | A2 | 11/1997 |
| WO | WO 99/23298 | A1 | 5/1999 |
| WO | WO 00/59439 | A1 | 10/2000 |
| WO | WO 00/78536 | A1 | 12/2000 |
| WO | WO2007/133576 | A2 | 11/2007 |

OTHER PUBLICATIONS

Schimleck et al "Est of whole-tree kraft pulp yield of *E nitens* using near-IR spectra from increment cores", Can. J. For. Res. 35(2005), pp. 1-2, [retrieved on Jul. 28, 2009], Retrieved from Internet: <URL: http://rparticle.web-p.cisti.nrc.ca/rparticle/ AbstractTemplateServlet?calyLang=eng&journal=cjfr&volume=35 &year=2005&issue=12&msno=x05-193.pdf>.*

Muneri et al, "Nondestructive sampling of *Eucalyptus globulus* and *E. nitens* for wood properties: II. Fibre length and coarseness", Wood Science and Technology 35 (2001) pp. 41-56, [retrieved on Jul. 29, 2009], Retrieved from the Internet: <URL:http://www.springerlink.com/content/2ubryujewhcc63n5/fulltext.pdf>.*

Yokoyama et al "Microanalytical Method for the Characterization of Fiber Components and Morphology of Woody Plants", J. Agric. Food Chem. 50 (2002), pp. 1040-1044, [retrieved on Jul. 28, 2009], Retrieved from the Internet: <URL:http://pubs.acs.org|doi: 10.1021/jf011173q.pdf>.*

PCT International Search Report Mailed Apr. 4, 2008, 15 pages.

R. P. Kibblewhite, et al., "*Kraft Pulp Qualities of Eucalyptus nitens, E. globulus, and E. maidenii at Ages 8 and 11 Years*", New Zealand Journal of Forestry Science, 30(3): pp. 447-457, (2000).

* cited by examiner

*Primary Examiner* — Matthew Daniels
*Assistant Examiner* — Dennis Cordray
(74) *Attorney, Agent, or Firm* — C. Brant Cook

(57) ABSTRACT

Fibrous structures, especially fibrous structures that exhibit softness and strength, sanitary tissue products employing such fibrous structures and methods for making such fibrous structures are provided. More particularly, fibrous structures that have a long fiber furnish that comprises less than 10% by weight of fibers having a coarseness of less than 20 mg/100 m, sanitary tissue products employing such fibrous structures and methods for making such fibrous structures are provided.

19 Claims, No Drawings

SOFT AND STRONG FIBROUS STRUCTURES

CROSS REFERENCE TO RELATED APPLICATIONS

This application claims the benefit of U.S. Provisional Application No. 60/860,179 filed Nov. 20, 2006 and U.S. Provisional Application No. 60/831,358 filed Jul. 17, 2006.

FIELD OF THE INVENTION

The present invention relates to fibrous structures, especially fibrous structures that exhibit softness and strength, sanitary tissue products comprising such fibrous structures and methods for making such fibrous structures. More particularly, the present invention relates to fibrous structures that comprise a long fiber furnish that comprises less than 10% by weight of fibers having a coarseness of less than 20 mg/100 m, sanitary tissue products comprising such fibrous structures and methods for making such fibrous structures.

BACKGROUND OF THE INVENTION

Fibrous structures, especially fibrous structures that are incorporated into sanitary tissue products, have contained long fiber furnishes. The long fiber furnishes have included significantly more than 10% by weight of fibers from a furnish having a coarseness of less than 20 mg/100 m. For example, conventionally, such fibrous structures have comprised long fiber furnishes predominantly of Northern Softwood Kraft (NSK) type pulp fibers because they deliver better softness than Southern Softwood Kraft (SSK) or Tropical Softwood Kraft (TSK) pulps. NSK pulp fibers typically exhibit a coarseness of less than 20 mg/100 m. Such NSK pulp fibers are used to provide strength to the fibrous structure since they deliver higher tensiles than coarser pulp fibers, such as coarser NSK fibers and/or SSK pulp fibers and/or TSK fibers, but they provide greater softness properties to the fibrous structures than these furnishes which display coarseness above 20 mg/100 m.

Formulators would continue using low coarseness pulp furnishes, such as NSK, in their fibrous structures. However, the demand for low coarseness NSK pulp fibers has outstripped supply thus resulting in higher prices and less availability for traditional low coarseness NSK pulp fibers, thus resulting in formulators trying to develop fibrous structures that have reduced levels of low coarseness long fibered pulp furnishes (i.e., less than 10% by weight of low coarseness long fibers in a long fiber furnish) while delivering fibrous structures with comparable strength and softness properties as those fibrous structures that comprise greater levels of low coarseness pulp fibers (i.e., greater than 10% by weight of low coarseness pulp fibers in a long fiber furnish).

Accordingly, there is a need for fibrous structures that comprise long fiber furnishes wherein the long fiber furnish comprises less than 10% by weight of fibers having a coarseness of less than 20 mg/100 m (e.g. NSK pulp fibers), sanitary tissue products comprising such fibrous structures and methods for making such fibrous structures.

SUMMARY OF THE INVENTION

The present invention fulfills the needs described above by providing a fibrous structure that exhibits sufficient strength and softness properties even though the long fiber furnish within the fibrous structure comprises from 0% to less than 10% by weight of a fiber furnish that exhibits a coarseness of less than 20 mg/100 m.

In one example of the present invention, a fibrous structure comprising a long fiber furnish wherein the long fiber furnish comprises from 0% to less than 10% by weight of a long fiber furnish having a coarseness of less than 20 mg/100 m, is provided.

In another example of the present invention, a fibrous structure comprising a long fiber furnish and a short fiber furnish wherein the long fiber furnish comprises fibers that are at least 50% and/or at least 100% and/or at least 200% longer than fibers of the short fiber furnish and wherein the long fiber furnish comprises from 0% to less than 10% by weight of a long fiber furnish having a coarseness of less than 20 mg/100 m, is provided.

In yet another example of the present invention, a layered fibrous structure comprising a long fiber furnish layer, wherein the long fiber furnish layer has an average fiber length 20% longer than average fiber length in other layers and wherein the long fiber furnish layer comprises from 0% to less than 10% by weight of fibers having a coarseness of less than 20 mg/100 m.

In even another example of the present invention, a fibrous structure comprising greater than 10% by weight of *Eucalyptus nitens* pulp fibers, is provided.

In still another example of the present invention, a layered fibrous structure comprising *Eucalyptus nitens* pulp fibers, is provided.

In even another example of the present invention, a single- or multi-ply sanitary tissue product comprising a fibrous structure of the present invention is provided.

In yet another example of the present invention, a method for making a fibrous structure comprising the step of depositing a long fiber furnish wherein the long fiber furnish comprises from 0% to less than 10% by weight of a long fiber furnish having a coarseness of less than 20 mg/100 m, is provided.

Accordingly, the present invention provides fibrous structures that comprise a long fiber furnish wherein the long fiber furnish comprises from 0% to less than 10% by weight of a long fiber furnish having a coarseness of less than 20 mg/100 m, sanitary tissue products comprising such fibrous structures and methods for making such fibrous structures.

DETAILED DESCRIPTION OF THE INVENTION

Definitions

"Fiber" as used herein means an elongate particulate having an apparent length greatly exceeding its apparent width, i.e. a length to diameter ratio of at least about 10. More specifically, as used herein, "fiber" refers to papermaking fibers. The present invention contemplates the use of a variety of papermaking fibers, such as, for example, natural fibers or synthetic fibers, or any other suitable fibers, and any combination thereof. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be used since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. U.S. Pat. No. 4,300,981 and U.S. Pat. No. 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

"Furnish" as used herein refers to a group of fibers of a fibrous structure or intended to be formed into a fibrous structure, collectively linked by their origin or characteristics. For example, the "short fiber furnish" is one which collectively includes all of the groups of fibers which may be classified as short fibers used in a fibrous structure. The short fiber furnish might be subdivided into short fiber furnishes, e.g., a tropical hardwood furnish, which may be further subdivided, for example, into the *Acacia* furnish and/or the *Eucalyptus* furnish which may be further subdivided; for example into the *Eucalyptus nitens* furnish. Similarly, the "long fiber furnish" collectively includes all of the groups of fibers which may be classified as long fibers used in a fibrous structure. The long fiber furnish may be further subdivided into specific long fiber furnishes, for example, the Northern softwood long fiber furnish, the Southern softwood long fiber furnish. These may be further subdivided as well; for example, the Northern softwood long fiber furnish may be comprised of the White Spruce long fiber furnish and/or the Lodgepole Pine long fiber furnish.

"Short fiber furnish" or "short fibers" as used herein means fibers that collectively have an average length of from about 0.4 mm to 1.2 mm and/or from about 0.5 mm to about 0.75 mm and/or from about 0.6 mm to about 0.7 mm. In one example, the short fiber furnish of the present invention exhibits an intrinsic tensile of greater than about 600 g/in.

Short fiber furnishes are generally hardwood pulps. Nonlimiting examples of short fibers of the present invention may be derived from a fiber source selected from the group consisting of *Acacia, Eucalyptus*, Maple, Oak, Aspen, Birch, Cottonwood, Alder, Ash, Cherry, Elm, Hickory, Poplar, Gum, Walnut, Locust, Sycamore, Beech, Catalpa, *Sassafras, Gmelina, Albizia, Anthocephalus, Magnolia*, Bagasse, Flax, Hemp, Kenaf and mixtures thereof.

"Long fiber furnish" or "long fibers" as used herein means a fiber furnish that collectively exhibits a length greater than 1.2 mm.

Nonlimiting examples of suitable long fibers include softwood pulp fibers. Nonlimiting examples of softwood pulp fibers include Northern Softwood Kraft pulp fibers (NSK), Southern Softwood Kraft pulp fibers (SSK) and Tropical Softwood Kraft pulp fibers (TSK). SSK pulp fibers exhibit a lower tensile and a higher coarseness than NSK pulp fibers. NSK pulp fibers generally exhibit a coarseness of less than 20 mg/100 m.

In addition to the various wood pulp fibers, other cellulosic fibers such as cotton linters, rayon, and bagasse can be used in this invention. Synthetic fibers and/or non-naturally occurring fibers, such as polymeric fibers, can also be used. Nonlimiting examples of polymeric fibers include hydroxyl polymer fibers, with or without a crosslinking system. Nonlimiting examples of suitable hydroxyl polymers that make up hydroxyl polymer fibers include polyols, such as polyvinyl alcohol, polyvinyl alcohol derivatives, polyvinyl alcohol copolymers, starch, starch derivatives, chitosan, chitosan derivatives, cellulose, cellulose derivatives such as cellulose ether and ester derivatives, gums, arabinans, galactans, proteins and various other polysaccharides and mixtures thereof. For example, a fibrous structure of the present invention may comprise a continuous and/or substantially continuous fiber comprising a starch hydroxyl polymer and a polyvinyl alcohol hydroxyl polymer produced by dry spinning and/or solvent spinning (both unlike wet spinning into a coagulating bath) a composition comprising the starch hydroxyl polymer and the polyvinyl alcohol hydroxyl polymer. Other types of polymeric fibers include fibers comprising elastomeric polymers, polypropylene, polyethylene, polyester, polyolefin, and nylon. The polymeric fibers can be produced by spunbond processes, meltblown processes, and other suitable methods known in the art.

An embryonic fibrous web can be typically prepared from an aqueous dispersion of papermaking fibers, though dispersions in liquids other than water can be used. The fibers are dispersed in the carrier liquid to have a consistency of from about 0.1 to about 0.3 percent. It is believed that the present invention can also be applicable to moist forming operations where the fibers are dispersed in a carrier liquid to have a consistency of less than about 50% and/or less than about 10%.

In one embodiment, the short fiber furnish is comprised of tropical hardwood pulp.

In another embodiment, the short fiber furnish comprises *eucalyptus* pulp fibers. *Eucalyptus* pulp fibers include *Eucalyptus grandis* and *Eucalyptus nitens*. *Eucalyptus nitens* pulp fibers deliver a higher tensile than *Eucalyptus grandis* pulp fibers.

The short fibers of the present invention may comprise cellulose and/or hemicellulose. In one example, the short fibers comprise cellulose.

The length and/or coarseness of the fibers may be determined using a Kajaani FiberLab Fiber Analyzer commercially available from Metso Automation, Kajaani Finland. As used herein, fiber length is defined as the "length weighted average fiber length". The instructions supplied with the unit detail the formula used to arrive at this average. However, the recommended method used to determine fiber lengths and coarseness of fiber specimens essentially the same as detailed by the manufacturer of the Fiber Lab. The recommended consistencies for charging to the Fiber Lab are somewhat lower than recommended by the manufacturer since this gives more reliable operation. Short fiber furnishes, as defined herein, should be diluted to 0.02-0.04% prior to charging to the instrument. Long fiber furnishes, as defined herein, should be diluted to 0.15%-0.30%. Alternatively, the length and coarseness of the short fibers may be determined by sending the fibers to an outside contract lab, such as Integrated Paper Services, Appleton, Wis.

"Tensile of fibers" or "intrinsic tensile strength" is measured by preparing uncreped handsheet fibrous structures containing such fibers. For example, in order to measure the tensile of a specific type of *Eucalyptus* fiber; namely *Eucalytpus grandis*, an uncreped handsheet consisting of only *Eucalyptus grandis* is prepared.

An uncreped handsheet fibrous structure containing a fiber is made without the use of a through air dryer is prepared as follows. 30 grams of fiber is diluted in 2000 ml water to form a fiber slurry (fiber furnish). The fiber slurry is then diluted to 0.1% consistency on a dry fiber basis in a 20,000 ml proportioned to form a diluted fiber slurry. A volume of about 2543 ml of the diluted fiber slurry is added to a deckle box containing 20 liters of water. The bottom of the deckle box contains a 33 cm by 33 cm (13.0 inch by 13.0 inch) Polyester Monofilament plastic forming wire supplied by Appleton Wire Co. Appleton, Wis. The wire is of a 5-shed, satin weave configuration having 84 machine-direction and 76 cross-machine-direction monofilaments per inch, respectively. The filament size is approximately 0.17 mm in both directions. The diluted fiber slurry is uniformly distributed onto the forming wire by moving a perforated metal deckle box plunger from near the top of the diluted fiber slurry to the bottom of the diluted fiber slurry back and forth for three complete "up and down" cycles. The "up and down" cycle time is approximately 2 seconds. The plunger is then withdrawn slowly. The water is then filtered through the forming wire. After the water is drained through the forming wire the deckle box is opened and the Forming wire and an embryonic fibrous structure formed from the fiber slurry are removed. The forming wire containing the embryonic fibrous structure is next pulled across a vacuum slot to further dewater the embryonic fibrous structure. The peak vacuum is approximately 4 in Hg. The embryonic fibrous structure is transferred from the forming wire to a drying cloth (a 44M from Appleton Wire, or equivalent) by use of a vacuum of 9.5 to 10 inches Hg. The direction of motion of transfer to the drying cloth is the same as the dewatering pass over the vacuum. The wet web and the drying cloth are dried together on a steam drum dryer. The drum has a circumference of approximately 1 meter. It rotates at a rate of approximately 0.9 rpm at a temperature of approximately 230° F. The dryer is wrapped with an endless wool felt 203 cm (80 inches) in circumference by 40.64 cm (16 in wide) (No. 11614 style x225) Nobel and Wood Lab Machine Company, Hoosick Falls, N.Y. The felt is wrapped to cover 63% of the dryer circumference. The fibrous structure is first passed between the felt and dryer with the drying fabric adjacent to the dryer drum, then a second pass is made with the fibrous structure adjacent to the dryer drum. The direction of travel of the fibrous structure is the same as used in the vacuum steps and this direction is thus referred to as the machine direction. The fibrous structure is then separated from the drying fabric. The fibrous structure is conditioned as described herein in the "Total Dry Tensile Test" method before testing.

In order to compare the tensile of one fiber furnish to another fiber furnish, uncreped handsheet fibrous structures of a sample of each the fiber furnishes is formed and then the tensile of that fiber furnish type is measured as the intrinsic tensile strength The "intrinsic tensile strength" of a fiber furnish type as used herein means the maximum strength of the machine direction of this uncreped handsheet fibrous structure (in units of g/in). The tensile breaking strength is measured using a tensile test machine, such as an Intelect II STD, available from Thwing-Albert, Philadelphia, Pa. The maximum tensile breaking strength is measured at a cross head speed of 0.5 inch per minute for uncreped handsheet samples. The value of tensile breaking strength is reported as an average of at least five measurements. The value for intrinsic tensile strength (ITS) is corrected to a constant basis weight of 26.8 gsm by taking the measured tensile value of the breaking strength and multiplying by the following basis weight correction factor (BWCF): BWCF=(17.08/(MBWV−9.72)) where MBWV is the measured basis weight value. Therefore, the intrinsic tensile strength is equal to: ITS*BWCF.

"Fibrous structure" as used herein means a structure that comprises one or more fibers. In one example, a fibrous structure according to the present invention means an orderly arrangement of fibers within a structure in order to perform a function. Nonlimiting examples of fibrous structures of the present invention include composite materials (including reinforced plastics and reinforced cement), paper, fabrics (including woven, knitted, and non-woven), and absorbent pads (for example for diapers or feminine hygiene products). A bag of loose fibers is not a fibrous structure in accordance with the present invention.

Nonlimiting examples of processes for making fibrous structures include known wet-laid papermaking processes and air-laid papermaking processes. Such processes typically include steps of preparing a fiber composition in the form of a suspension in a medium, either wet, more specifically aqueous medium, or dry, more specifically gaseous, i.e. with air as medium. The aqueous medium used for wet-laid processes is oftentimes referred to as a fiber slurry. The fibrous suspension is then used to deposit a plurality of fibers onto a forming wire or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking, and may subsequently be converted into a finished product, e.g. a sanitary tissue product.

The fibrous structures of the present invention may be homogeneous or may be layered. If layered, the fibrous structures may comprise at least two and/or at least three and/or at least four and/or at least five layers.

The fibrous structures and/or sanitary tissue products of the present invention may exhibit a basis weight of between about 10 g/m$^2$ to about 120 g/m$^2$ and/or from about 14 g/m$^2$ to about 80 g/m$^2$ and/or from about 20 g/m$^2$ to about 60 g/m$^2$.

The structures and/or sanitary tissue products of the present invention may exhibit a total (i.e. sum of machine direction and cross machine direction) dry tensile strength of greater than about 59 g/cm (150 g/in) and/or from about 78 g/cm (200 g/in) to about 394 g/cm (1000 g/in) and/or from about 98 g/cm (250 g/in) to about 335 g/cm (850 g/in).

The fibrous structure and/or sanitary tissue products of the present invention may exhibit a density of less than about 0.60 g/cm$^3$ and/or less than about 0.30 g/cm$^3$ and/or less than about 0.20 g/cm$^3$ and/or less than about 0.10 g/cm$^3$ and/or less than about 0.07 g/cm$^3$ and/or less than about 0.05 g/cm$^3$ and/or from about 0.01 g/cm$^3$ to about 0.20 g/cm$^3$ and/or from about 0.02 g/cm$^3$ to about 0.10 g/cm$^3$.

In one example, the fibrous structure of the present invention is a pattern densified fibrous structure characterized by having a relatively high-bulk region of relatively low fiber density and an array of densified regions of relatively high fiber density. The high-bulk field is characterized as a field of pillow regions. The densified zones are referred to as knuckle regions. The knuckle regions exhibit greater density than the pillow regions. The densified zones may be discretely spaced within the high-bulk field or may be interconnected, either fully or partially, within the high-bulk field. Typically, from about 8% to about 65% of the fibrous structure surface comprises densified knuckles, the knuckles may exhibit a relative density of at least 125% of the density of the high-bulk field. Processes for making pattern densified fibrous structures are well known in the art as exemplified in U.S. Pat. Nos. 3,301,746, 3,974,025, 4,191,609 and 4,637,859.

The fibrous structures in accordance with the present invention may be in the form of through-air-dried fibrous structures, differential density fibrous structures, differential basis weight fibrous structures, wet laid fibrous structures, air laid fibrous structures (examples of which are described in U.S. Pat. Nos. 3,949,035 and 3,825,381), conventional dried fibrous structures, creped or uncreped fibrous structures, patterned-densified or non-patterned-densified fibrous structures, compacted or uncompacted fibrous structures, non-woven fibrous structures comprising synthetic or multicomponent fibers, homogeneous or multilayered fibrous structures, double re-creped fibrous structures, foreshortened fibrous structures, co-form fibrous structures (examples of which are described in U.S. Pat. No. 4,100,324) and mixtures thereof.

In one example, the air laid fibrous structure is selected from the group consisting of thermal bonded air laid (TBAL) fibrous structures, latex bonded air laid (LBAL) fibrous structures and mixed bonded air laid (MBAL) fibrous structures.

The fibrous structures may exhibit a substantially uniform density or may exhibit differential density regions, in other words regions of high density compared to other regions within the patterned fibrous structure. Typically, when a fibrous structure is not pressed against a cylindrical dryer, such as a Yankee dryer, while the fibrous structure is still wet and supported by a through-air-drying fabric or by another fabric or when an air laid fibrous structure is not spot bonded, the fibrous structure typically exhibits a substantially uniform density.

"Sanitary tissue product" as used herein means a soft, low density (i.e. <about 0.15 g/cm3) web useful as a wiping implement for post-urinary and post-bowel movement cleaning (toilet tissue), for otorhinolaryngological discharges (facial tissue), and multi-functional absorbent and cleaning uses (absorbent towels). The sanitary tissue product may be convolutedly wound upon itself about a core or without a core to form a roll of sanitary tissue product.

In one example, the sanitary tissue product of the present invention comprises a fibrous structure according to the present invention.

"Basis Weight" as used herein is the weight per unit area of a sample reported in lbs/3000 $ft^2$ or $g/m^2$. Basis weight is measured by preparing one or more samples of a certain area ($m^2$) and weighing the sample(s) of a fibrous structure according to the present invention and/or a paper product comprising such fibrous structure on a top loading balance with a minimum resolution of 0.01 g. The balance is protected from air drafts and other disturbances using a draft shield. Weights are recorded when the readings on the balance become constant. The average weight (g) is calculated and the average area of the samples ($m^2$). The basis weight ($g/m^2$) is calculated by dividing the average weight (g) by the average area of the samples ($m^2$).

"Machine Direction" or "MD" as used herein means the direction parallel to the flow of the fibrous structure through the papermaking machine and/or product manufacturing equipment.

"Cross Machine Direction" or "CD" as used herein means the direction perpendicular to the machine direction in the same plane of the fibrous structure and/or paper product comprising the fibrous structure.

"Total Dry Tensile Strength" or "TDT" of a fibrous structure of the present invention and/or a sanitary tissue product comprising such fibrous structure is measured as follows. One (1) inch by five (5) inch (2.5 cm×12.7 cm) strips of fibrous structure and/or sanitary tissue product comprising such fibrous structure are provided. The strip is placed on an electronic tensile tester Model 1122 commercially available from Instron Corp., Canton, Mass. in a conditioned room at a temperature of 73° F.±4° F. (about 28° C.±2.2° C.) and a relative humidity of 50%±10%. 4.0 inches per minute (about 10.2 cm/minute) and the gauge length is 4.0 inches (about 10.2 cm). The TDT is the arithmetic total of MD and CD tensile strengths of the strips.

"Caliper" as used herein means the macroscopic thickness of a sample. Caliper of a sample of fibrous structure according to the present invention is determined by cutting a sample of the fibrous structure such that it is larger in size than a load foot loading surface where the load foot loading surface has a circular surface area of about 3.14 $in^2$. The sample is confined between a horizontal flat surface and the load foot loading surface. The load foot loading surface applies a confining pressure to the sample of 15.5 $g/cm^2$ (about 0.21 psi). The caliper is the resulting gap between the flat surface and the load foot loading surface. Such measurements can be obtained on a VIR Electronic Thickness Tester Model II available from Thwing-Albert Instrument Company, Philadelphia, Pa. The caliper measurement is repeated and recorded at least five (5) times so that an average caliper can be calculated. The result is reported in millimeters.

"Apparent Density" or "Density" as used herein means the basis weight of a sample divided by the caliper with appropriate conversions incorporated therein. Apparent density used herein has the units $g/cm^3$.

"Softness" of a fibrous structure according to the present invention and/or a paper product comprising such fibrous structure is determined as follows. Ideally, prior to softness testing, the samples to be tested should be conditioned according to Tappi Method #T4020M-88. Here, samples are preconditioned for 24 hours at a relative humidity level of 10 to 35% and within a temperature range of 22° C. to 40° C. After this preconditioning step, samples should be conditioned for 24 hours at a relative humidity of 48% to 52% and within a temperature range of 22° C. to 24° C. Ideally, the softness panel testing should take place within the confines of a constant temperature and humidity room. If this is not feasible, all samples, including the controls, should experience identical environmental exposure conditions.

Softness testing is performed as a paired comparison in a form similar to that described in "Manual on Sensory Testing Methods", ASTM Special Technical Publication 434, published by the American Society For Testing and Materials 1968 and is incorporated herein by reference. Softness is evaluated by subjective testing using what is referred to as a Paired Difference Test. The method employs a standard external to the test material itself. For tactile perceived softness two samples are presented such that the subject cannot see the samples, and the subject is required to choose one of them on the basis of tactile softness. The result of the test is reported in what is referred to as Panel Score Unit (PSU). With respect to softness testing to obtain the softness data reported herein in PSU, a number of softness panel tests are performed. In each test ten practiced softness judges are asked to rate the relative softness of three sets of paired samples. The pairs of samples are judged one pair at a time by each judge: one sample of each pair being designated X and the other Y. Briefly, each X sample is graded against its paired Y sample as follows:

1. a grade of plus one is given if X is judged to may be a little softer than Y, and a grade of minus one is given if Y is judged to may be a little softer than X;

2. a grade of plus two is given if X is judged to surely be a little softer than Y, and a grade of minus two is given if Y is judged to surely be a little softer than X;

3. a grade of plus three is given to X if it is judged to be a lot softer than Y, and a grade of minus three is given if Y is judged to be a lot softer than X; and, lastly:

4. a grade of plus four is given to X if it is judged to be a whole lot softer than Y, and a grade of minus 4 is given if Y is judged to be a whole lot softer than X.

The grades are averaged and the resultant value is in units of PSU. The resulting data are considered the results of one panel test. If more than one sample pair is evaluated then all sample pairs are rank ordered according to their grades by paired statistical analysis. Then, the rank is shifted up or down in value as required to give a zero PSU value to which ever sample is chosen to be the zero-base standard. The other samples then have plus or minus values as determined by their relative grades with respect to the zero base standard. The number of panel tests performed and averaged is such that about 0.2 PSU represents a significant difference in subjectively perceived softness.

"Ply" or "Plies" as used herein means an individual fibrous structure optionally to be disposed in a substantially contiguous, face-to-face relationship with other plies, forming a multiple ply fibrous structure. It is also contemplated that a single fibrous structure can effectively form two "plies" or multiple "plies", for example, by being folded on itself.

As used herein, the articles "a" and "an" when used herein, for example, "an anionic surfactant" or "a fiber" is understood to mean one or more of the material that is claimed or described.

All percentages and ratios are calculated by weight unless otherwise indicated. All percentages and ratios are calculated based on the total composition unless otherwise indicated.

Unless otherwise indicated, all tests described herein including those described under the Definitions section and the following test methods are conducted on samples, fibrous structure samples and/or sanitary tissue product samples and/or handsheets that have been conditioned in a conditioned room at a temperature of 73° F.±4° F. (about 23° C.±2.2° C.) and a relative humidity of 50%±10% for 2 hours prior to the test. Further, all tests are conducted in such conditioned room. Tested samples and felts should be subjected to 73° F.±4° F. (about 23° C.±2.2° C.) and a relative humidity of 50%±10% for 2 hours prior to testing.

Unless otherwise noted, all component or composition levels are in reference to the active level of that component or composition, and are exclusive of impurities, for example, residual solvents or by-products, which may be present in commercially available sources.

Fibrous Structures:

The fibrous structures of the present invention comprise from 0% to less than 10% by weight of long fibers having a coarseness of less than 20 mg/100 m. In one example, a fibrous structure of the present invention comprises 0% or about 0% by weight of long fibers having a coarseness of less than 20 mg/100 m—for example 0% or about 0% by weight of NSK pulp fibers. In another example, a fibrous structure of the present invention comprises from 0% to about 5% by weight of long fibers having a coarseness of less than 20 mg/100 m—for examples from 0% to about 5% by weight of NSK pulp fibers.

Various other pulp fibers and/or other fibers may be incorporated into the fibrous structures of the present invention.

In one example, a fibrous structure of the present invention comprises a greater weight percent of long fiber furnishes having a coarseness of 20 mg/100 m or greater. For example, a fibrous structure of the present invention may comprise a long fiber furnish that comprises at least 20% and/or at least 40% and/or at least 50% and/or at least 60% and/or at least 75% and/or at least 90% and/or 100% by weight of the coarse long fiber furnish; e.g., of SSK pulp fibers.

In another example, a fibrous structure of the present invention comprises a short fiber furnish. For example, a fibrous structure of the present invention may comprise *eucalyptus* pulp fibers and/or *acacia* pulp fibers—both being short fibers. Further, a fibrous structure of the present invention may comprise two different types of a fiber—for example the fibrous structure may comprise *Eucalyptus grandis* pulp fibers and *Eucalyptus nitens* pulp fibers.

In another example, a fibrous structure of the present invention may comprise a fiber type, such as *eucalyptus* pulp fibers, having at least two different fibers that exhibit different properties. For example, one of the *eucalyptus* pulp fibers may exhibit a higher tensile and/or higher coarseness than the other *eucalyptus* pulp fibers within the fibrous structure. For example, the fibrous structure may comprise *Eucalyptus nitens* pulp fibers, which exhibit a higher tensile than *Eucalyptus grandis* pulp fibers, and *Eucalyptus grandis* pulp fibers. In one example, a fibrous structure of the present invention may comprise a short fiber furnish comprising about 70% by weight of the short fiber furnish of *Eucalyptus grandis* pulp fibers and about 30% by weight of the short fiber furnish of *Eucalyptus nitens* pulp fibers. In another example, a fibrous structure of the present invention may comprise a short fiber furnish comprising about 50% by weight of the short fiber furnish of *Eucalyptus grandis* pulp fibers and about 50% by weight of the short fiber furnish of *Eucalyptus nitens* pulp fibers. In another example, a fibrous structure of the present invention may comprise a short fiber furnish comprising about 30% by weight of the short fiber furnish of *Eucalyptus grandis* pulp fibers and about 70% by weight of the short fiber furnish of *Eucalyptus nitens* pulp fibers. In another example, a fibrous structure of the present invention may comprise a short fiber furnish comprising about 0% by weight of the short fiber furnish of *Eucalyptus grandis* pulp fibers and about 100% by weight of the short fiber furnish of *Eucalyptus nitens* pulp fibers.

The fibrous structures of the present invention may be homogeneous or layered. If layered, the fibrous structure may comprise two or more layers that comprise different fiber furnishes (different in fiber makeup and/or levels of fibers within each layer). In one example, a layered fibrous structure comprises a long fiber furnish and a short fiber furnish. In another example, a layered fibrous structure comprises an inner long fiber furnish and outer short fiber furnishes. In another example, a layered fibrous structure comprising an outer long fiber furnish.

The fibrous structures of the present invention may comprise short fiber furnishes with intrinsic tensile strength greater than 600 g/in. Such short fiber furnishes might be comprised of never dried short fiber furnishes, refined short fiber furnishes, high hemicellulose short fiber furnishes, cellulase-treated short fiber furnishes, or combinations thereof.

Optional Ingredients

Fibrous structures of the present invention may further comprise additional optional ingredients selected from the group consisting of bulk softening agents, surface softening agents, lotions, permanent and/or temporary wet strength resins, dry strength resins, wetting agents, lint resisting agents, absorbency-enhancing agents, antiviral agents including organic acids, antibacterial agents, polyol polyesters, antimigration agents, polyhydroxy plasticizers and mixtures thereof. Such optional ingredients may be added to the fiber furnish, the embryonic fibrous web and/or the fibrous structure.

Such optional ingredients may be present in the fibrous structures at any level based on the dry weight of the fibrous structure.

The optional ingredients may be present in the fibrous structures at a level of from about 0.001 to about 50% and/or from about 0.001 to about 20% and/or from about 0.01 to about 5% and/or from about 0.03 to about 3% and/or from about 0.1 to about 1.0% by weight, on a dry fibrous structure basis.

In one example, the fibrous structure of the present invention comprises a bulk softening agent. Nonlimiting examples of suitable bulk softening agents according to the present invention are liquids under ambient conditions. For the purpose of the present invention, ambient condition includes a temperature below about 30° C. In one example, a bulk softening agent in accordance with the present invention exhibits a low surface tension, such as below about 40 dyne/cm determined according to ASTM D2578. Preferred bulk softening agents are capable of migrating effectively throughout the fibrous structure and/or sanitary tissue product. One means of achieving effective migration capability of the bulk softening agents according to the present invention is the exclusion of components capable of forming bonds with bonding moieties present on the fibers of the fibrous structures. For example, by being absent hydroxyl group or amide group functionalities, preferred bulk softening agents herein are incapable of hydrogen bonding with hydroxyl moieties present on cellulose fibers. By being absent tertiary or quaternary amine moieties the bulk softening agents herein are incapable of ion exchange with uronic acid groups of cellulosic fibers preferred for use in the fibrous structures herein. By being absent aldehyde functionalities, the bulk softening agents herein are not capable of forming hemiacetal linkages through adjacent hydroxyl groups of cellulosic fibers preferred for use in the fibrous structures herein.

In one example, the bulk softening agent comprises an oil. Nonlimiting suitable oils include oils derived from mineral, animal or vegetable sources.

In one example, the oil comprises mineral oil. A suitable mineral oil is distributed by Chevron Corporation of San Ramon, Calif. under the tradename "Paralux", such as Paralux 1001 and/or Paralux 6001.

Natural animal and vegetable oils may also be used as the oil. These are triglycerides, i.e. they are glycerol fatty esters with no remaining hydroxyl functionality. The range of fatty chains commonly varies from C8 to C22, with C16 and C18 being the most common. The fatty acid chains can be saturated or unsaturated. In one example, the fatty acid chains will either be unsaturated or shorter (for example C12 or less), both of which tend to liquefy the oil. Saturated and long chain length triglycerides are room temperature solids which are preferred for the present invention. Examples of suitable oils at each end of the spectrum are palm olein which is a longer chain length oil having a high level of unsaturation and MCT oil derived from coconut or palm kernel, which is a short chain length but fully saturated oil. The oil of the present invention may comprise any of the before mentioned oils and in one example, comprises a triglyceride with a specific fatty acid profile. Namely, it may have a fatty acid profile containing a palmitic acid content of greater than about 15 wt % of the triglyceride. In another example, an oil of the present invention has a triglyceride having a fatty acid profile containing a myristic acid content of from greater than about 0.5 to about 15 wt % and/or from about 1 to about 10 wt % and/or from about 1 to about 5 wt % of the oil. In one example, an oil of the present invention, especially a vegetable oil, more especially a palm oil, even more especially a liquid fraction of palm oil; namely, palm olein, comprises a triglyceride that exhibits a cis/trans ratio of greater than about 8 In yet another example, an oil of the present invention comprises a triglyceride having a fatty acid profile containing a linolenic acid content of less than about 2 wt % to 0%. In still another example, an oil of the present invention comprises at least about 50% and/or at least about 75% and/or at least about 90% to about 100% of a triglyceride, especially a triglyceride that exhibits a cis/trans ratio of greater than about 8.

Similarly some animal oils are also suitable. However, many animal oils contain too much high molecular weight and/or saturated fat, which makes them not as desirable as other oils. Marine oils are most suitable since they are either absent or can be more easily purified of solid fats, solid monoesters, etc.

Synthetic oils are also suitable. Synthetic mineral oils include those made from synthetic crude oil, i.e. upgraded bitumen. Synthetic oils created by the polymerization of methane by the Fischer-Tropsch process are also suitable.

Synthetic oils made by esterification of alcohols with fatty acids are also suitable or similar processes are included. For example, a methyl ester of fatty acids derived from soybean oil is suitable. The process used to create this oil is to saponify the triglyercide, i.e. soybean oil, with caustic soda in the presence of methanol. This yields glycerine and the methyl esters of the fatty acids, which can be readily separated. The methyl esters thus produce include a blend of methyl stearate, methyl linoleate, methyl linoleneate, and methyl palmitate and minor fractions of others. Similarly, fatty esters of carbohydrates may also be acceptable if the exhibit adequate fluidity and insufficient alcohol groups remain to retard migration.

Synthetic oils also suitably include silicone oils preferably limited to about 10% of an oil system, i.e. comprising other oils. Silicone oils are typically polydimethylsiloxane based materials but may contain other functional groups within or appended to the silicone backbone.

Method for Making Fibrous Structure

The fibrous structures of the present invention may be made by any suitable method known in the art.

Nonlimiting examples of methods for making the fibrous structures of the present invention include wet-laid, air-laid and coforming.

In one example, a method for making a fibrous structure comprises the step of depositing a fiber furnish comprising from 0% to less than 10% by weight of the fiber furnish of a long fiber having a coarseness of less than 20 mg/100 m on to a belt to form a fibrous structure.

The process may further comprise the step of drying the fibrous structure.

The process may be a through-air-dried process or a conventionally pressed process.

The belt in the process may be a structure belt with a pattern, especially a non-random repeating pattern.

The fiber furnish may be a short fiber furnish. The process may comprise depositing a one or more layers of a long fiber furnish and one or more layers of a short fiber furnish onto the belt.

EXAMPLE

This Example illustrates a process incorporating an embodiment of the present invention using the pilot scale Fourdrinier to make a toilet tissue product. An aqueous slurry of Southern Softwood Kraft (SSK) (about 25 mg/100 m coarseness, from Alabama River Pulp Mill) of about 3% consistency is made up using a conventional pulper and the furnish is passed through a stock pipe toward the headbox of the Fourdrinier.

In order to aid in delivering a temporary wet strength to the finished product, a 1% dispersion of Cytec's Parez 750C is prepared and is added to the SSK stock pipe at a rate sufficient to deliver 0.2% of the resin based on the dry weight of the ultimate paper. The absorption of the temporary wet strength resin is enhanced by passing the treated slurry through an in-line mixer.

The SSK slurry furnish is diluted with white water to about 0.2% consistency at the fan pump.

An aqueous slurry of a *Eucalyptus* pulp furnish comprising about 70% of *Eucalyptus grandis* and 30% *Eucalyptus nitens* (Chilean, from Empresas CMPC) of about 3% by weight is made up using a conventional repulper and the furnish is passed through a stock pipe toward the headbox of the Fourdrinier. In order to aid in delivering temporary wet strength to the finished product, the 1% dispersion of Cytec's Parez 750C is also added to the CMPC furnish stock pipe at a rate sufficient to deliver 0.05% of the resin based on the dry weight of the ultimate paper. The absorption of the temporary wet strength resin is enhanced by passing the treated slurry through an in-line mixer. The CMPC slurry furnish passes to the second fan pump where it is diluted with white water to a consistency of about 0.2%.

The slurries of SSK and *Eucalyptus* are directed into a multi-channeled headbox suitably equipped with layering leaves to maintain the streams as separate layers until discharged onto a traveling Fourdrinier wire. A three-chambered headbox is used. The *acacia* slurry containing 70% of the dry weight of the ultimate paper is directed to the chambers leading to the outer layers, while the SSK slurry comprising 30% of the dry weight of the ultimate paper is directed to the chamber leading to the central layer.

The SSK and *Eucalyptus* slurries are combined at the discharge of the headbox into a composite slurry and the composite slurry is discharged onto the traveling Fourdrinier wire and is dewatered assisted by a deflector and vacuum boxes.

The embryonic wet web is transferred from the Fourdrinier wire, at a fiber consistency of about 15% at the point of transfer, to a patterned drying fabric. The drying fabric is designed to yield a pattern-densified tissue with discontinuous low-density deflected areas arranged within a continuous network of high density (knuckle) areas. This drying fabric is formed by casting an impervious resin surface onto a fiber mesh supporting fabric. The supporting fabric is a 45×52 filament, dual layer mesh. The thickness of the resin cast is about 10 mil above the supporting fabric. The knuckle area is about 40% and the open cells remain at a frequency of about 78 per square inch.

Further de-watering is accomplished by vacuum assisted drainage until the web has a fiber consistency of about 30%. While remaining in contact with the patterned forming fabric, the patterned web is pre-dried by air blow-through pre-dryers to a fiber consistency of about 65% by weight. The semi-dry web is then transferred to the Yankee dryer and adhered to the surface of the Yankee dryer with a sprayed creping adhesive comprising a 0.125% aqueous solution of polyvinyl alcohol. The creping adhesive is delivered to the Yankee surface at a rate of 0.1% adhesive solids based on the dry weight of the web. The fiber consistency is increased to about 98% before the web is dry creped from the Yankee with a doctor blade.

The doctor blade has a bevel angle of about 25 degrees and is positioned with respect to the Yankee dryer to provide an impact angle of about 81 degrees. The Yankee dryer is operated at a temperature of about 350° F. (177° C.) and a speed of about 800 fpm (feet per minute) (about 244 meters per minute). The paper is wound in a roll using a surface driven reel drum having a surface speed of about 656 feet per minute.

The resulting tissue paper web is converted into a two-ply toilet tissue paper product using a conventional tissue winding stand. The finished product has a basis weight of about 30 lb/3000 ft2; a total dry tensile of 450 g/in and a density of 0.065 g/cm$^3$.

A comparative product not according to the present invention is made in the same manner as this example except that a 100% *Eucalyptus* bleached kraft fibrous pulp (Brazilian, Aracruz) is substituted for the CMPC bleached kraft pulp and an NSK (about 17 mg/100 m, from Weyerhauser, Grande Prairie) is substituted for the Alabama River SSK. The resultant tissue paper using the comparative furnish is judged less soft by a panel of expert judges.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A creped, layered fibrous structure comprising a softwood pulp fiber furnish comprising 100% by weight of softwood pulp fibers that exhibit a coarseness of 20 mg/100 m or greater and a hardwood pulp fiber furnish comprising 30% by weight or greater of *Eucalyptus nitens* pulp fibers.

2. The fibrous structure according to claim 1 wherein the softwood pulp fiber furnish comprises Softwood Kraft pulp fibers selected from the group consisting of Southern Softwood Kraft and Tropical Softwood Kraft and mixtures thereof.

3. The fibrous structure according to claim 1 wherein the hardwood pulp fiber furnish comprises tropical hardwood pulp fibers selected from the group consisting of acacia, other eucalyptus, and mixtures thereof.

4. The fibrous structure of claim 1 wherein the hardwood pulp fiber furnish has an intrinsic tensile strength greater than about 600 g/in.

5. A single- or multi-ply sanitary tissue product comprising a fibrous structure according to claim 1.

6. A creped layered fibrous structure comprising a softwood pulp fiber furnish layer comprising 100% by weight of softwood pulp fibers that exhibit a coarseness of 20 mg/100 m or greater and a hardwood pulp fiber furnish layer comprising 30% by weight or greater of *Eucalyptus nitens* pulp fibers.

7. The fibrous structure according to claim 6 wherein softwood pulp fiber furnish layer comprises Softwood Kraft pulp fibers selected from the group consisting of Southern Softwood Kraft and Tropical Softwood Kraft and mixtures thereof.

8. The fibrous structure according to claim 6 wherein the hardwood pulp fiber furnish layer comprises tropical hardwood pulp fibers selected from the group consisting of acacia, other eucalyptus, and mixtures thereof.

9. The fibrous structure of claim 6 wherein the hardwood pulp fiber furnish layer has an intrinsic tensile strength greater than about 600 g/in.

10. The fibrous structure according to claim 6 wherein the softwood pulp fiber furnish layer is sandwiched between two other fiber furnish layers.

11. The fibrous structure according to claim 6 wherein the softwood pulp fiber furnish layer comprises an exterior surface of the fibrous structure.

12. A single- or multi-ply sanitary tissue product comprising a fibrous structure according to claim 6.

13. The fibrous structure according to claim 1 wherein the fibrous structure further comprises a bulk softening agent.

14. A fibrous structure comprising a softwood pulp fiber furnish comprising 100% by weight of Southern Softwood Kraft pulp fibers and a hardwood pulp fiber furnish comprising *Eucalyptus* pulp fibers wherein 30% by weight or greater of the hardwood pulp fiber furnish is *Eucalyptus nitens* pulp fibers, wherein the fibrous structure exhibits a softness greater than the softness of the fibrous structure in the absence of the *Eucalyptus nitens* pulp fibers.

15. The fibrous structure according to claim 14 wherein the hardwood pulp fiber furnish comprises 50% by weight or greater of *Eucalyptus nitens* pulp fibers.

16. The fibrous structure according to claim 15 wherein the hardwood pulp fiber furnish comprises 70% by weight or greater of *Eucalyptus nitens* pulp fibers.

17. The fibrous structure according to claim 14 wherein the fibrous structure comprises a layered fibrous structure.

18. The fibrous structure according to claim 17 wherein a layer of the softwood pulp fiber furnish is sandwiched between two layers of the hardwood pulp fiber furnish.

19. A single- or multi-ply sanitary tissue product comprising a fibrous structure according to claim 14.

* * * * *